US011391445B2

(12) United States Patent
Liu et al.

(10) Patent No.: US 11,391,445 B2
(45) Date of Patent: Jul. 19, 2022

(54) LUMINOUS NOZZLE AND NOZZLE BASE THEREOF

(71) Applicant: Guangzhou Rising Dragon Recreation Industrial Co., Ltd., Guangzhou (CN)

(72) Inventors: Xuewen Liu, Guangzhou (CN); Huaibin Zhao, Guangzhou (CN)

(73) Assignee: GUANGZHOU RISING DRAGON RECREATION INDUSTRIAL CO., LTD., Guangzhou (CN)

( * ) Notice: Subject to any disclaimer, the term of this patent is extended or adjusted under 35 U.S.C. 154(b) by 0 days.

(21) Appl. No.: 17/035,728

(22) Filed: Sep. 29, 2020

(65) Prior Publication Data

US 2022/0082234 A1 Mar. 17, 2022

(30) Foreign Application Priority Data

Sep. 15, 2020 (CN) ..... 202022012896.9

(51) Int. Cl.

| | |
|---|---|
| ***F21V 19/00*** | (2006.01) |
| ***F21V 31/00*** | (2006.01) |
| ***F21V 33/00*** | (2006.01) |
| ***B05B 1/00*** | (2006.01) |
| ***F21Y 115/10*** | (2016.01) |

(52) U.S. Cl.

CPC ..... *F21V 19/0015* (2013.01); *F21V 31/005* (2013.01); *F21V 33/004* (2013.01); *B05B 1/00* (2013.01); *F21Y 2115/10* (2016.08)

(58) Field of Classification Search

CPC . F21V 7/0091; F21Y 2113/10; F21Y 2115/10

See application file for complete search history.

(56) References Cited

U.S. PATENT DOCUMENTS

| | | | | |
|---|---|---|---|---|
| 6,644,561 | B1 * | 11/2003 | Daane | B05B 15/74 239/18 |
| 8,550,643 | B2 * | 10/2013 | Kownacki | F21V 33/004 362/96 |
| 9,320,088 | B2 * | 4/2016 | Laporte | F21V 17/16 |
| 9,475,080 | B2 * | 10/2016 | Lee | B05B 17/08 |
| 9,719,667 | B2 * | 8/2017 | Drury | F21V 21/088 |
| 10,317,023 | B2 * | 6/2019 | Li | B29C 48/154 |
| 2005/0218801 | A1 * | 10/2005 | Hon | H01L 33/507 313/512 |

* cited by examiner

*Primary Examiner* — Matthew J. Peerce

(74) *Attorney, Agent, or Firm* — Andrew C. Cheng

(57) ABSTRACT

The present disclosure relates to a luminous nozzle and a nozzle base thereof. The nozzle base includes a nozzle base body and a fastener. The fastener cooperates with a cover to clamp the nozzle base body for installation and fixation. The nozzle base body includes a water inlet portion and a water spray portion communicated with each other. A predetermined number of lamp holes are provided transversely on an outer periphery of the water inlet portion. The luminous nozzle includes a nozzle core and a predetermined number of SMD LED lamps and further includes the above-mentioned nozzle base, with the nozzle core installed in the nozzle base body and the SMD LED lamps detachably installed in the lamp holes. This luminous nozzle has high light utilization efficiency and the SMD LED lamps have a stable installation structure and is easy to install and maintain.

16 Claims, 6 Drawing Sheets

LUMINOUS NOZZLE AND NOZZLE BASE THEREOF

TECHNICAL FIELD

The present disclosure generally relates to the technical field of bathtub nozzle lamps and, in particular, to a luminous nozzle and a nozzle base thereof.

RELATED ART

With the improvement of living standards, people's pursuit of quality of life is becoming higher and higher, and the outdoor jacuzzi industry has developed accordingly. While people are pursuing the function of the massage bathtub, they also put forward higher requirements on lighting effect of the bathtub. At this stage, a main lighting method for bathtub nozzles on the market is to provide a lamp to a lock nut of a nozzle base. This lighting method requires an additional lamp housing, the installation of which is complicated and not reliable so that the housing is easy to fall off during transportation. What is even more criticized is that the lighting effect provided by this lighting method is uneven, and the light utilization efficiency is not high. Therefore, there is an urgent need for bathtub nozzles to provide a lighting solution with simple and reliable installation. More importantly, it is able to achieve an uniform lighting effect and improved light utilization efficiency.

SUMMARY OF INVENTION

In view of the above situation, the present disclosure mainly solves issues of low light utilization efficiency, complicated installation and uneven lighting effect in the prior luminous nozzle provided on the bathtub, and makes a design on the nozzle base of the luminous nozzle, thereby providing a luminous nozzle and a nozzle base thereof.

For this purpose, the present disclosure provides a nozzle base, which includes a nozzle base body and a fastener, wherein the fastener cooperates with a cover to clamp the nozzle base body for installation and fixation, the nozzle base body includes a water inlet portion and a water spray portion communicated with each other, and a predetermined number of lamp holes are provided transversely on an outer periphery of the water inlet portion.

Further, the lamp holes and the nozzle base are integrally formed, so that the lamp holes form more stable structures.

Preferably, a side of the lamp hole close to the water spray portion and an outer peripheral surface of the water spray portion form an angle of 75°, which adjusts the light emitting angle to improve the light utilization efficiency of the light source and make the lighting effect more uniform.

Further, the lamp hole is a round through-hole or a square through-hole, and such through-hole structure may make the installation of the lamp more stable, and allow a stop structure to be designed for a portion of the lamp protruding from the lamp hole. In this nozzle base, the outer peripheral lamp holes are provided at an end of the water inlet portion close to the water spray portion and luminous surfaces of the lamp holes face the water spray portion such that the light can be emitted from a bottom of the nozzle base in a water spray direction. Compared with the conventional light emitting from sides of the nozzle base, the nozzle base of the present disclosure improves the light utilization efficiency. Secondly, the transversely provided lamp hole provides an installation orientation perpendicular to the water spray direction of the nozzle base, such that the lamp can be installed in the transverse/lateral direction of the nozzle base. Such design of transversely provided lamp hole makes installation, maintenance and replacement of the lamp easier and more convenient. Compared with the conventional vertical installation, the transverse installation of the lamp makes the lamp not easy to fall off, and there is no need to design installation matching structure, which makes the overall installation structure of the luminous nozzle more stable.

The present disclosure also provides a luminous nozzle, which includes a nozzle core and a predetermined number of SMD LED lamps, and further includes the nozzle base according to any one of items as described above, with the nozzle core installed in the nozzle base body and the SMD LED lamps detachably installed in the lamp holes.

Preferably, the SMD LED lamp includes a rubber-coated shell and includes a circuit board and a predetermined number of LED lamp beads enclosed in the rubber-coated shell, the LED lamp beads are attached in a length direction of the circuit board, and the light emitting direction of the lamp beads faces the water spray portion.

Preferably, the rubber-coated shell is a transparent rubber material rubber-coated shell.

Preferably, the SMD LED lamp is mounted in the lamp hole with an interference fit.

Preferably, the SMD LED lamp is provided with a stop structure to prevent the SMD LED lamp from falling off the lamp hole.

Preferably, an installation orientation of the SMD LED lamp is perpendicular to an axial direction of the water spray portion. The water spray direction of the nozzle is parallel to the axial direction of the lights shooting out from the SMD LED lamps.

In the luminous nozzle, the above-mentioned nozzle base is used together with the SMD LED lamp so as to emit the light in the water spray direction, such that the high light utilization efficiency is achieved for the luminous nozzle. At the same time, the transversely inserted SMD LED lamps make the overall structure of the luminous nozzle more reliable. In addition, the SMD LED lamps are used, and thus there is no need to increase any matching structure for the lamp holes, which reduces the cost while achieving simple installation and plug-and-play, and making the overall luminous nozzle easy to maintain.

DETAILED DESCRIPTION OF EMBODIMENTS

The technical solution of the present disclosure will be further explained below in conjunction with the drawings and embodiments.

Embodiments

Figure 1:
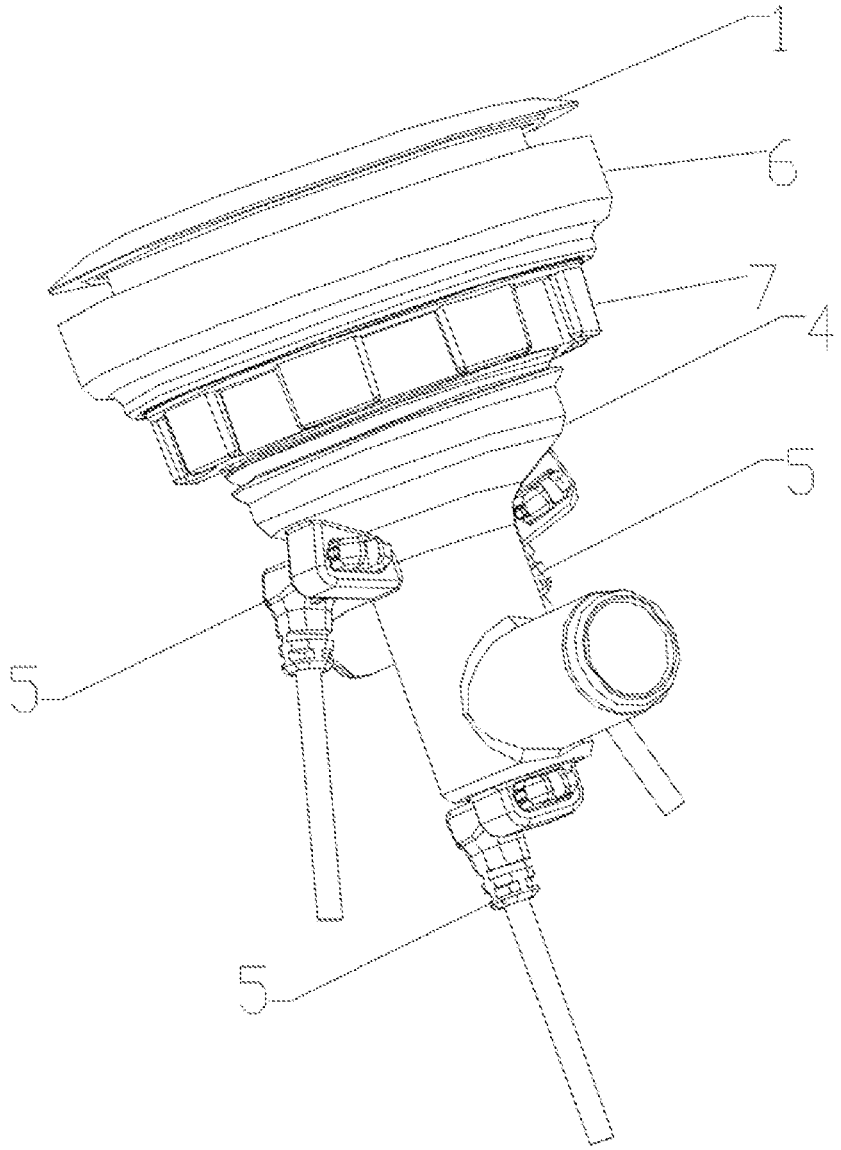
FIG. 1 is a perspective schematic view of a luminous nozzle according to the present disclosure.
Figure 2:
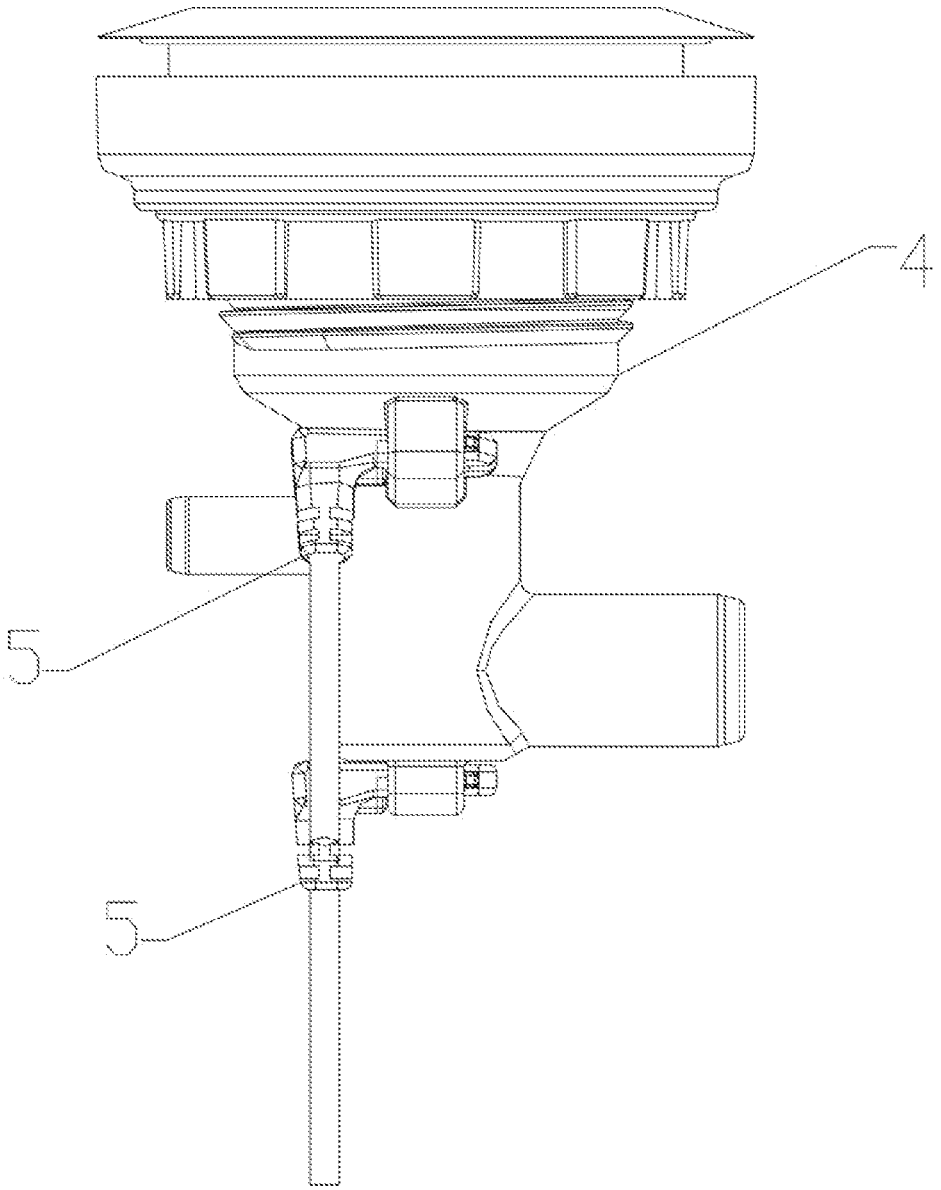
FIG. 2 is a side view of the luminous nozzle according to the present disclosure.
Figure 3:
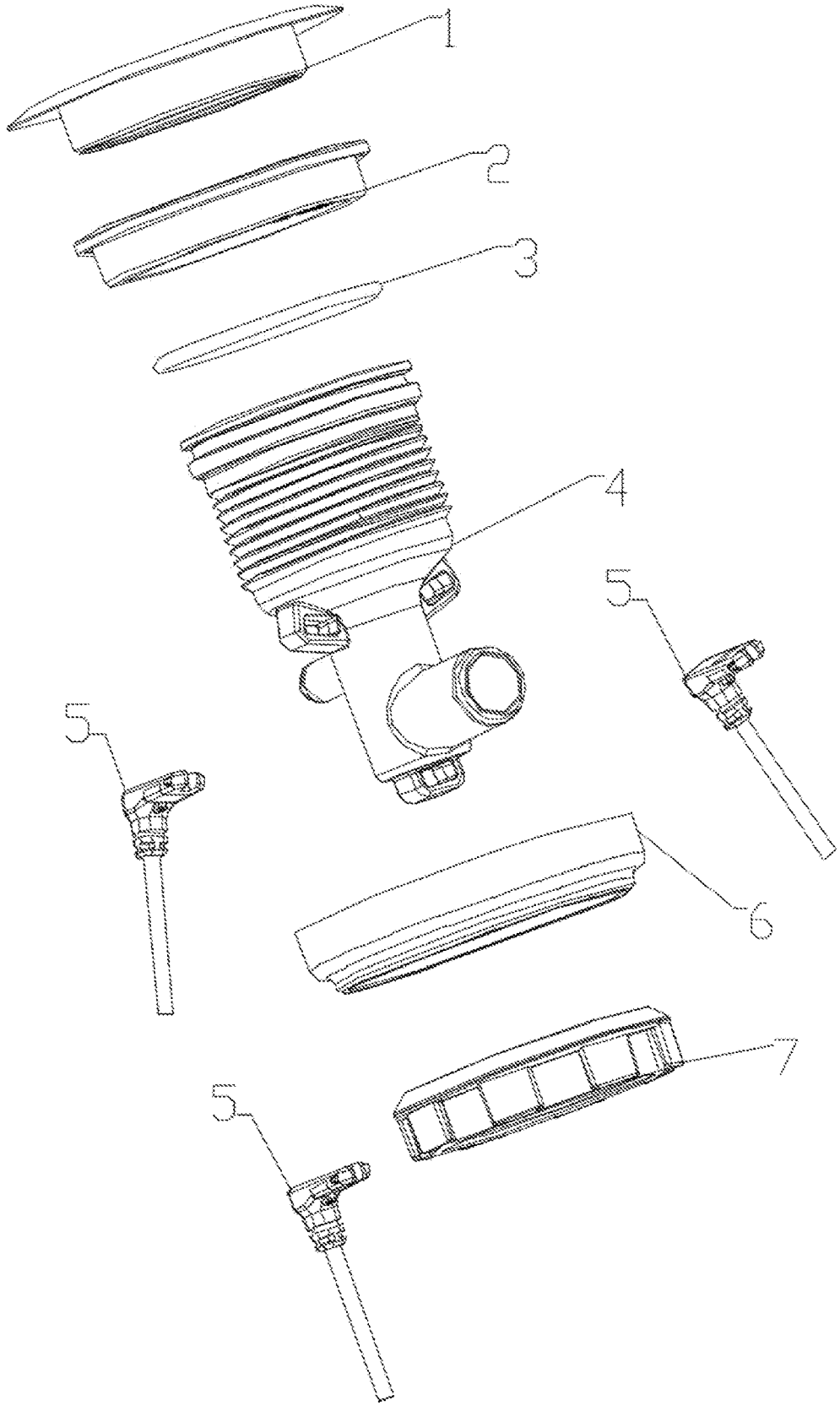
FIG. 3 is an exploded schematic view of the structure of the luminous nozzle according to the present disclosure.

Referring to FIG. 1, FIG. 2 and FIG. 3, this embodiment provides a luminous nozzle, which is mounted to a bathtub wall and includes a cover 1, an L-shaped sealing ring 2, an O-shaped sealing ring 3, a nozzle base body 4, a fastener 6, a clamping nut 7, three SMD LED lamps 5 and a nozzle core (not shown).

Figure 4:
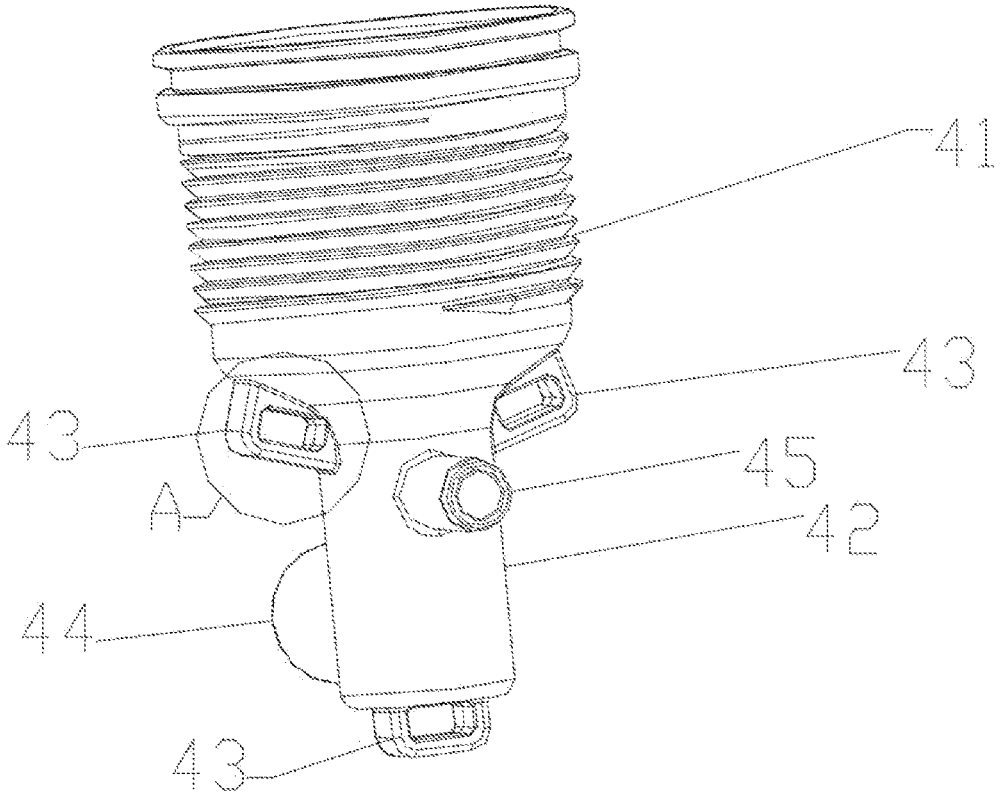
FIG. 4 is a perspective schematic view of a nozzle base according to the present disclosure.
Figure 5:
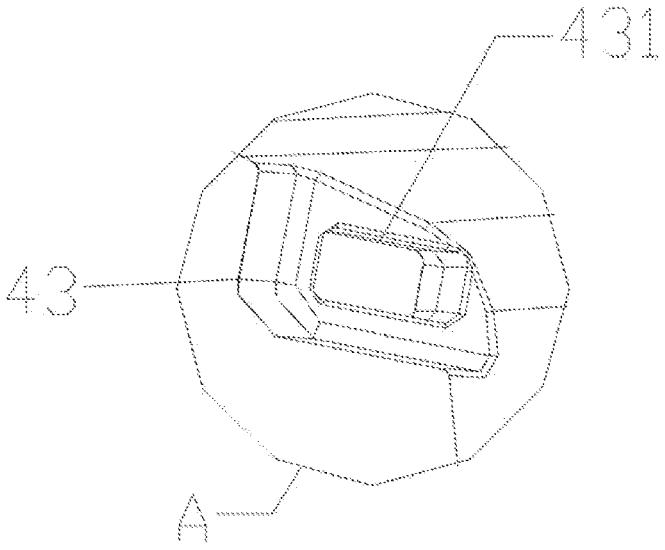
FIG. 5 is an enlarged schematic view of an area A in FIG. 4.
Figure 6:
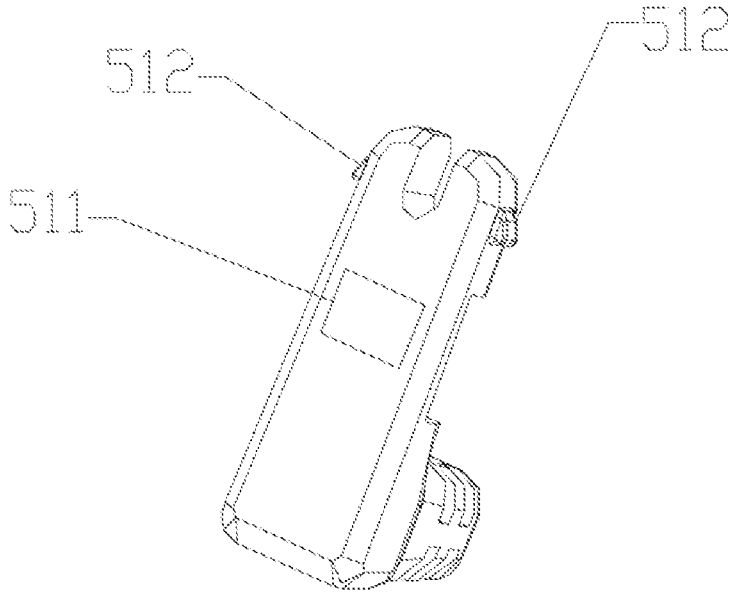
FIG. 6 is a perspective schematic view of a SMD LED lamp according to the present disclosure.
Figure 7:
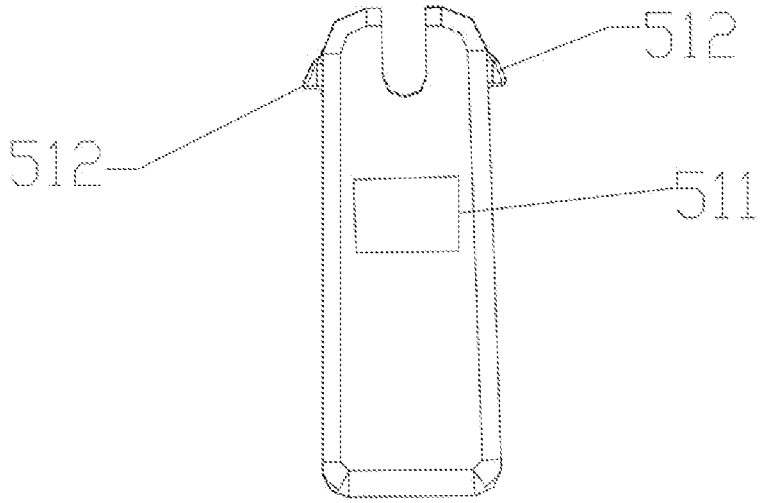
FIG. 7 is a top schematic view of the SMD LED lamp in FIG. 6.
Figure 8:
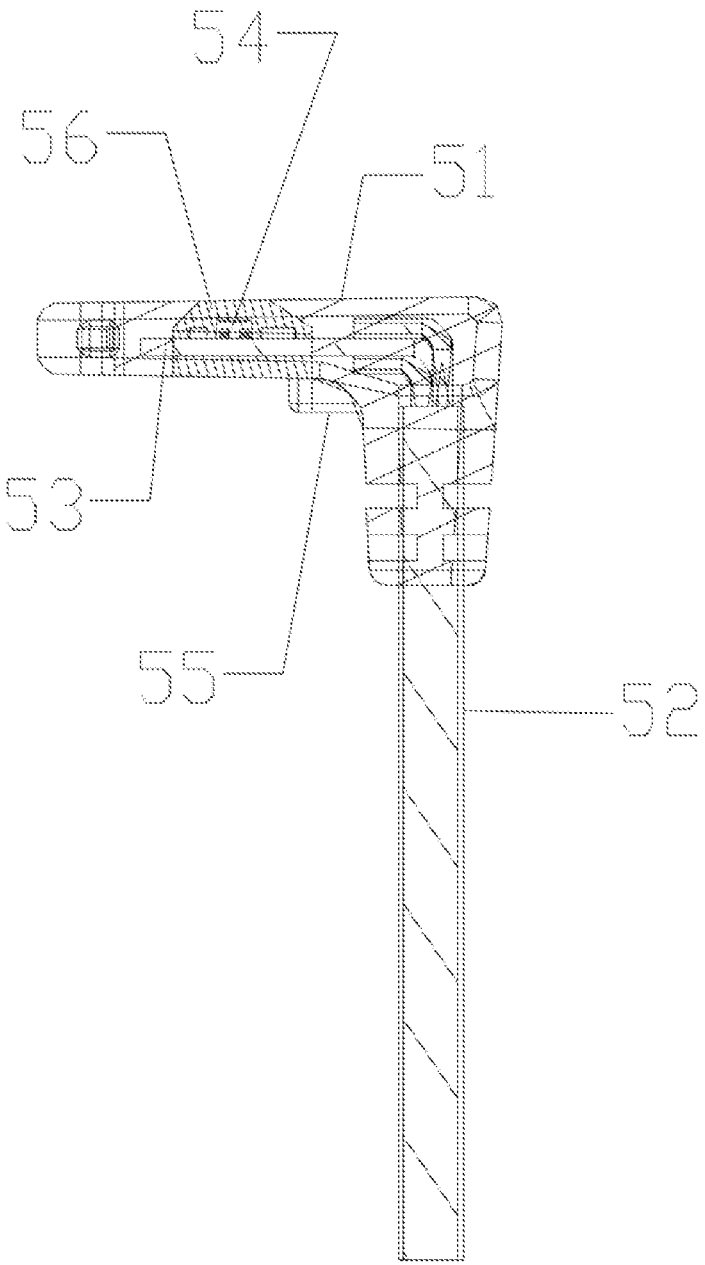
FIG. 8 is a cross-sectional view of the SMD LED lamp according to the present disclosure.

Specifically, with reference to FIGS. 1, 4 and 5, the nozzle base 4 includes a water inlet portion 42 and a water spray portion 41 that are communicated with each other. The water inlet portion 42 is provided with a water inlet pipe 44 and an air inlet pipe 45. The water spray portion 41 has a diameter larger than that of the water inlet portion 42, and is provided with an external thread on an outer periphery thereof. The clamping nut 7 cooperates with the fastener 6 and the cover 1 to fix the nozzle base 4 to the bathtub wall. Two lamp holes 43 are transversely provided on an outer periphery of the water inlet portion 42 at an end of the water inlet portion 42 close to the water spray portion 41, with an orientation of each lamp hole 43 perpendicular to a water spray direction of the nozzle base body 4. Of course, according to user's requirements, any number of the lamp holes 43 may also be provided, and positions of the lamp holes may also be adjusted appropriately. In this embodiment, a bottom of the nozzle base body 4 is also provided with one lamp hole 43. These lamp holes 43 may be integrally formed with the nozzle base body 4, and such integrally formed structure of lamp holes is more stable. In this embodiment, the lamp holes 43 are square through-holes. Of course, the lamp holes 43 may also be round through-holes. The round or square lamp holes are convenient to the design and installation of the SMD LED lamps 5, and the design of through-holes make the installed SMD LED lamps 5 more stable. The SMD LED lamps 5 may be installed through the through-hole so as to prevent them from falling off. In addition, in order to improve the light source utilization efficiency, an angle of 70° to 85° is formed between a side surface 431 of the lamp hole 43 close to the water spray portion 41 and the outer peripheral surface of the water spray portion 41. In this embodiment, the angle is 75°.

Secondly, the L-shaped sealing ring 2 and the O-shaped sealing ring 3 achieve radial and axial sealing of the luminous nozzle in an installation state, respectively.

In addition, referring to FIG. 1, FIG. 4, FIG. 6, FIG. 7 and FIG. 8, in this embodiment, in order to adapt to the lamp hole 43, the present disclosure also provides an L-shaped SMD LED lamp 5, which is detachably installed in the lamp hole 43 and includes a rubber-coated shell 51, a wire 52 and a circuit board 53 and a LED lamp bead 54 enclosed in the rubber-coated shell 51. The lamp beads 54 may be one or more. When a plurality of lamp beads 54 are provided, these lamp beads 54 are attached in a length direction of the circuit board 53, and after the SMD LED lamp 5 is installed in the lamp hole 43, the light emitting surfaces of the lamp beads 54 are close to the side surface 431 of the lamp hole 43 close to the water spray portion, the lamp beads 54 emit light toward the water spray portion 41, and each lamp bead 54 is a sheet-shaped lamp bead with an effective luminous angle of 70°. Specifically, a light outlet aperture 511 is provided in a top of the rubber-coated shell. The water spray direction of the nozzle is parallel to the axial direction of the lights shooting out from the SMD LED lamps. In order to improve the stability of the installation structure and better provide a stop function of preventing the SMD LED lamp 5 from falling off, the rubber-coated shell 51 is formed with a notch at its end to be inserted and mounted, with stop blocks 512 provided on two sides of the end to be inserted and mounted respectively. The rubber-coated shell 51 is inserted into the lamp hole 43 with an interference fit so as to achieve the installation. The inserted end passes through and protrudes from the lamp hole 43, and the stop blocks 512 on both sides of the inserted end abut against the boundary of the lamp hole 43 to realize the stop function of preventing the SMD LED lamp 5 from falling off the lamp hole 43. In addition, the rubber-coated shell 51 is also provided with a limit block 55, which cooperates with the stop blocks 512 to stably retain the SMD LED lamp 5 in the lamp hole 43 and prevent the SMD LED lamp 5 from sliding in the lamp hole 43. Secondly, the rubber-coated shell 51 is also provided with an injection-molded transparent rubber head 56 therein. The injection-molded transparent rubber head plays the role of light transmission, anti-collision, sealing and waterproofing. Such a structure of secondary packaging tightly wraps the LED lamp bead 54 and does not destroy the LED lamp bead 54 while preventing other external things from damaging the LED lamp bead.

In addition, in this embodiment, the wire 52 has a white PVC outer skin such that the LED lamp can be used in an environment of −20° C. to 105° C. for a long time. Similarly, the rubber-coated shell 51 is made of white 75° PVC material, which also increases the service life of the LED lamp. In order to further lengthen the product life, a waterproof layer is provided on an outer side wall of the circuit board 53, which improves the waterproof performance of the circuit board 53 such that it is suitable for more various environments. The waterproof layer may be a UV glue/adhesive waterproof layer, insulation paint waterproof layer or a EPTFE micro-porous film waterproof layer. Preferably, it is the UV glue/adhesive waterproof layer.

Finally, in this embodiment, the cover 1 is made of plastic, metal or other materials, and the nozzle base 4 is made of transparent or light-transmitting materials.

When the luminous nozzle according to the present disclosure is used, the light is emitted in the water spray direction, which improves the light utilization efficiency, and the lamp has a stable installation structure and is easy to install and maintain, which improves user experience while reducing manufacturing and maintenance costs.

The above descriptions are only specific implementations of the present disclosure, but those skilled in the art should understand that they are only exemplary, and the protection scope of the present disclosure is defined by the appended claims. Therefore, the equivalent changes made to the scope of the present disclosure still fall within the scope covered by the present disclosure.

What is claimed is:

1. A nozzle base comprising a nozzle base body and a fastener, wherein the fastener cooperates with a cover to clamp the nozzle base body for installation and fixation, the nozzle base body comprises a water inlet portion and a water spray portion communicated with each other, and a predetermined number of lamp holes are provided transversely on an outer periphery of the water inlet portion, the lamp holes being through holes and an orientation of the lamp holes being perpendicular to an axial direction of the nozzle base body so that SMD LED lamps can be transversely and detachably installed through the lamp holes, wherein the lamp holes and the nozzle base are integrally formed.

2. The nozzle base according to claim 1, wherein a bottom of an end of the water inlet portion facing away from the water spray portion is provided with at least one of the lamp holes, and two of the lamp holes are transversely provided at an opposite end of the water inlet portion close to the water spray portion.

3. The nozzle base according to claim 1, wherein the lamp holes are square through holes.

4. The nozzle base according to claim 1, wherein an angle is formed between a side of the lamp hole close to the water spray portion and an outer peripheral surface of the water spray portion, and the angle ranges from 70° to 85°.

5. The nozzle base according to claim 1, wherein the lamp hole is a round through-hole or a square through-hole.

6. The nozzle base according to claim 1, wherein the fastener is axially located between the cover and the nozzle base body, and the nozzle base body is located at a side of the fastener away from the cover so that the L-shaped SMD LED lamps can be replaced without needing to detach the fastener from the cover.

7. A luminous nozzle comprising a nozzle core and a predetermined number of L-shaped SMD LED lamps, wherein the luminous nozzle further comprises a nozzle base, the nozzle base comprises a nozzle base body and a fastener, the nozzle core is installed in the nozzle base body, the fastener cooperates with a cover to clamp the nozzle base body for installation and fixation, the nozzle base body comprises a water inlet portion and a water spray portion communicated with each other, a plurality of lamp holes are provided transversely on an outer periphery of the water inlet portion, and an orientation of the lamp holes is perpendicular to an axial direction of the nozzle base body so that the L-shaped SMD LED lamps can be transversely and detachably installed into the lamp holes, wherein the L-shaped SMD LED lamp comprises a wire extending in a direction parallel to the axial direction of the nozzle base body.

8. The luminous nozzle according to claim 7, wherein the L-shaped SMD LED lamp comprises a rubber-coated shell, and a circuit board and a predetermined number of LED lamp beads that are enclosed in the rubber-coated shell, and the LED lamp beads are attached in a length direction of the circuit board, and have a light emitting direction toward the water spray portion.

9. The luminous nozzle according to claim 7, wherein the rubber-coated shell is a transparent-rubber-coated shell.

10. The luminous nozzle of claim 7, wherein the L-shaped SMD LED lamp is mounted to the lamp hole with an interference fit.

11. The luminous nozzle according to claim 7, wherein the L-shaped SMD LED lamp is provided with a stop structure engaged with the lamp hole via a snap fit joint to prevent the L-shaped SMD LED lamp from transversely falling off the lamp hole.

12. The luminous nozzle according to claim 7, wherein a water spray direction of the nozzle is parallel to an axial direction of lights shooting out from the L-shaped SMD LED lamps.

13. The luminous nozzle according to claim 7, wherein the fastener is axially located between the cover and the nozzle base body, and the nozzle base body is located at a side of the fastener away from the cover so that the L-shaped SMD LED lamps can be replaced without needing to detach the fastener from the cover.

14. The luminous nozzle according to claim 11, wherein the L-shaped SMD LED lamp is formed with a notch at its free end, the stop structure comprises a pair of stop blocks provided on two sides of the free end.

15. The luminous nozzle according to claim 11, wherein the lamp holes are through holes, and the stop structure extends through the lamp holes.

16. The luminous nozzle according to claim 7, wherein the lamp holes and the nozzle base are integrally formed.

* * * * *